US005695716A

United States Patent [19]

Köhler et al.

[11] Patent Number: 5,695,716

[45] Date of Patent: Dec. 9, 1997

[54] AUSTENITIC ALLOYS AND USE THEREOF

[75] Inventors: Michael Köhler, Iserlohn; Ulrich Heubner, Werdohl; Kurt-Wilhelm Eichenhofer, Leverkusen; Michael Renner, Leichlingen, all of Germany

[73] Assignees: Bayer Aktiengesellschaft, Leverkusen; Krupp VDM GmbH, Werdohl, both of Germany

[21] Appl. No.: 654,451

[22] Filed: May 21, 1996

Related U.S. Application Data

[63] Continuation of Ser. No. 350,193, Dec. 5, 1994, abandoned.

[30] Foreign Application Priority Data

Dec. 10, 1993 [DE] Germany ..... 43 42 188.1

[51] Int. Cl.[6] ..... C22C 30/00

[52] U.S. Cl. ..... 420/584.1; 420/586.1; 148/442

[58] Field of Search ..... 420/584.1, 586.1; 148/442

[56] References Cited

U.S. PATENT DOCUMENTS

| | | | |
|---|---|---|---|
| 3,565,611 | 2/1971 | Economy . | |
| 3,758,296 | 9/1973 | Johnson . | |
| 4,172,716 | 10/1979 | Abo et al. | 420/586.1 |
| 4,410,489 | 10/1983 | Asphahani et al. . | |
| 4,424,083 | 1/1984 | Polizzotti et al. . | |
| 4,543,244 | 9/1985 | Jones et al. . | |
| 4,670,242 | 6/1987 | McAlister et al. . | |
| 4,836,985 | 6/1989 | Culling et al. . | |
| 4,853,185 | 8/1989 | Rothman et al. . | |
| 5,296,054 | 3/1994 | Lvovich et al. . | |

FOREIGN PATENT DOCUMENTS

| | | | |
|---|---|---|---|
| 0200862 | 11/1986 | European Pat. Off. . | |
| 0249792 | 12/1987 | European Pat. Off. . | |
| 0261880 | 3/1988 | European Pat. Off. . | |
| 0292061 | 11/1988 | European Pat. Off. . | |
| 0340631 | 11/1989 | European Pat. Off. . | |
| 0438992 | 7/1991 | European Pat. Off. . | |
| 0361554 | 6/1993 | European Pat. Off. . | |
| 2626893 | 4/1989 | France . | |
| 5521547 | 2/1980 | Japan | 420/586.1 |
| 61-41746 | 2/1986 | Japan . | |
| 1534926 | 12/1978 | United Kingdom . | |

OTHER PUBLICATIONS

Abstract of JP 54–8,114 (1979).

Abstract of JP 1–259,143 (1989).

Abstract of JP 62–180,037 (1987).

Abstract of JP 5–70,892 (1993).

"Properties and Selection: Irons and Steels", Metals Handbook Ninth Edition, V. 1, Sep. 1978.

R. Quarfort, Corrosion Science, 29, No. 8, pp. 987–993 (1989).

P. Lau et al., Corrosion 85, Paper No. 64., Mar. 1995.

D. Kuron et al., Z Werkstofftech, 8 pp. 182–191 (1977).

E.M. Horn, et al., Werkstoffe und Korrosion 43, 191–200 (1992).

B. Wilde, Corrosion NACE, 28, No. 8, pp. 283–291 (1972).

B. Wollen, Werkstoffe und Korrosion 44, pp. 83–88 (1993).

E.–M. Horn, et al., Wekstoffe und Korrosion, 37, 57–69 (1986).

U. Heubner et al., Nickelwerkstoffe und hochlegierte Sonderedelstahle, vol. 153 (1985).

*Primary Examiner*—Deborah Yee

*Attorney, Agent, or Firm*—Sprung Kramer Schaefer & Briscoe

[57] ABSTRACT

The present invention relates to high chromium, corrosion resistant, austenitic alloys and to the use thereof.

23 Claims, 2 Drawing Sheets

AUSTENITIC ALLOYS AND USE THEREOF

Figure 1:
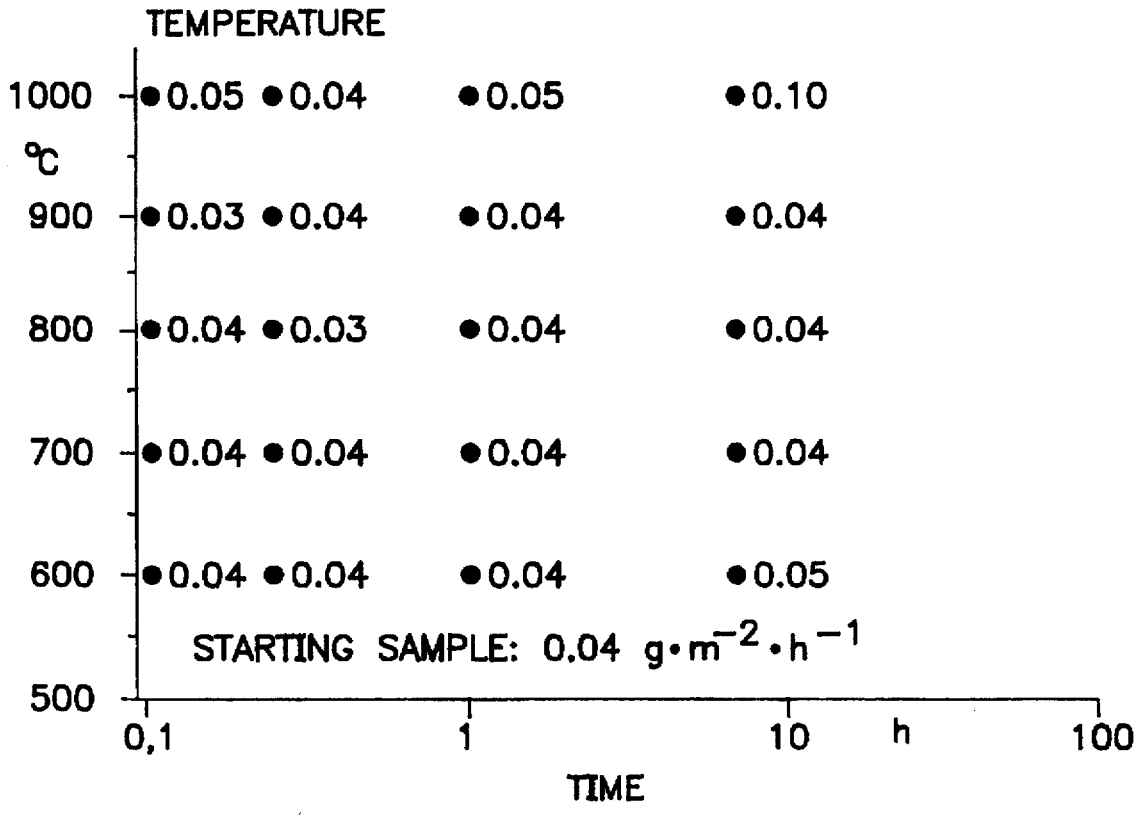

This application is a continuation of application Ser. No. 08/350,193 filed on Dec. 5, 1994, now abandoned.

The present invention relates to high chromium, corrosion resistant austenitic alloys and to the use thereof.

Table A, hereinbelow, shows examples of prior art metallic materials which are suitable for the handling of oxidizing acids (Nickellegierungen und hochlegierte Sonderedelst ähle [nickel alloys and high-alloy special steels], 2nd edition, Expert Verlag, 1993). With the exception of supefferrite, these materials are so-called austenitic alloys, i.e. alloys with a face-centered cubic lattice. The prior art alloys shown in Table A all have a content of the major alloy element, chromium, lying within a range between approximately 17 and 29 wt. %. Even relatively low-alloy materials are corrosion-resistant to nitric acid of a concentration of up to a maximum of 67%. Such a material is Cronifer 1809 LCLSi, wherein the suffix LSi indicates a low silicon content.

High-nickel materials, such as the Nicrofer 6030 also shown in Table A, offer advantages where halogen compounds are present or if nitric/hydrofluoric acid mixtures are being used, such as for example in the reprocessing of nuclear reactor fuel elements.

Various chromium/nickel/iron steels containing molybdenum with up to 29% chromium, up to 39% nickel and up to 6.5% molybdenum are described in Werkstoffe und Korrosion 43, 191–200 (1992), "Korrosion nichtrostender St ähle und Nickelbasislegierungen in Salpetersäure-Flußs äure-Gemischen" [Corrosion of stainless steels and nickel based alloys in nitric/hydrofluoric acid mixtures]. Resistance to nitric/hydrofluoric acid mixtures is improved at elevated molybdenum contents.

Austenitic special steels with up to 22% nickel, up to 25% chromium and nitrogen contents of 0.2 to 0.5 wt. % are described in Werkstoffe und Korrosion 44, 83–88 (1993) "Avesta 654 SMO TM-A new nitrogen-enhanced superaustenitic stainless steel".

Having a chromium content of 26 to 28%, the material Nicrofer 3127 hMo (1.4562) containing molybdenum according to EP 0 292 061 is of interest where particular importance is attached to high resistance to pitting and crevice corrosion in addition to relatively high resistance to nitric acid. A typical corrosion rate in boiling azeotropic nitric acid (Huey test) for this material is approximately 0.11 mm/year.

When working with nitric acid of over 67% or under otherwise exceptionally strongly oxidizing conditions, Cronifer 1815 LCSi (1.4361), which is alloyed with approximately 4% silicon, exhibits excellent resistance up to the boiling point of nitric acid. Materials which may be considered for urea production have a composition similar to that of steels which are particularly resistant to corrosion by nitric acid.

Nicrofer 2509 Si7 according to EP 0 516 955, which is alloyed with 7% silicon, was developed for working with hot, highly concentrated sulphuric acid. According to the teaching of DE-OS 38 30 365, the supefferrite Cronifer 2803 Mo (1.4575) is also of particular interest here. However, due to their limited workability, superferrites are only suitable for thin-walled articles, generally of 2 mm and less in thickness.

Alloys with approximately 31% chromium and approximately 46% chromium have been tested for corrosion resistance in nitric/hydrofluoric acid mixtures (Werkstoffe und Korrosion 43 (1992), p. 191–200). These high-chromium alloys could no longer be produced as austenitic materials. They had to be manufactured using special processes such as, for example, powder metallurgy.

British patent 1 114996 claims alloys with 14 to 35% chromium and 0 to 25% iron.

EP-A 0 261 880 describes alloys with 27 to 31% chromium, 7 to 11% iron and the remainder substantially nickel.

Alloys with chromium contents of higher than 30% Cr can no longer be produced homogeneously as austenitic materials. In practice, therefore, maximum chromium contents of 29% are used. Superferrite 1.4575 with chromium contents of 26 to 30% is a ferritic alloy.

EP-A 0 130 967 describes the suitability of nickel alloys and special steels for hot 99% to 101% sulphuric acid at >120° C. in heat exchangers. The alloys are selected using the following formula:

$$0.35\,(Fe—Mn)+0.70\,(Cr)+0.30\,(Ni)-0.12\,(Mo)>39.$$

The stated special steels containing molybdenum have a maximum of 28% chromium.

EP-A 0 200 862 claims molybdenum-free chromium, nickel alloys consisting of 21 to 35% chromium, 30 to 70% iron, 2 to 40% nickel and 0 to 20% manganese, together with the tramp elements for articles resistant to sulphuric acid of above 96% to 100% and to oleum.

EP-A 249 792 claims the use of alloys consisting of 21 to 55% chromium, 0 to 30% iron, 0 to 5% tungsten and 45 to 79% Ni in concentrated sulphuric acid.

U.S. Pat. No. 4,410,489 proposes an alloy consisting of 26 to 35% chromium, 2 to 6% molybdenum, 1 to 4% tungsten, 0.3 to 2% (niobium+tantalum), 1 to 3% copper, 10 to 18% iron, up to 1.5% manganese, up to 1% silicon, the remainder substantially nickel, for handling phosphoric acid. The chromium content should preferably be 30%.

DE-A 2 154 126 claims the use of austenitic nickel alloys with 26 to 48% nickel, 30 to 34% chromium, 4 to 5.25% molybdenum, 4 to 7.5% cobalt, 3 to 2.5% iron, 1 to 3.5% manganese, etc., as a corrosion resistant material for articles in hot sulphuric acid of at least 65%.

U.S. Pat. No. 4,853,185 describes special stainless steels with 25 to 45% nickel, 12 to 32% chromium, 0.1 to 2% niobium, 0.2 to 4% tantalum, 0.05 to 1% vanadium and 0.05 to 0.5% nitrogen, together with tramp elements. The alloys are intended to be resistant to CO, $CO_2$ and sulphur compounds.

According to U.S. Pat. No. 3,565,611, high chromium contents are important for the resistance of nickel/chromium/iron alloys to alkali-induced stress corrosion cracking in hot alkaline solutions. The chromium content should here be at least 18%, preferably at least 26 to 27%, up to a maximum of 35% and the iron content should be restricted to a maximum of 7%. Alloy 690, with 29% chromium and 9% iron, is particularly resistant to alkali-induced stress corrosion cracking.

U.S. Pat. No. 4,853,185 describes high temperature corrosion resistant alloys consisting of approximately 30% to 45% nickel, approximately 12 to 32% chromium, at least one of the elements niobium at 0.01% to 2.0%, tantalum at 0.2 to 4.0% and vanadium at 0.05 to 1.0%, together with up to 0.20% carbon, approximately 0.05 to 0.50% nitrogen, a quantity of titanium effective for high temperature strength of up to 0.20%, the remainder iron and impurities (tramp elements), wherein the sum of free carbon and nitrogen $(C+N)_F$ must be >0.14 and <0.29. The expression $(C+N)_F$ is defined in this case as:

$$(C+N)_F = C + N - \frac{Nb}{9} - \frac{V}{4.5} - \frac{Ta}{18} - \frac{Ti}{3.5}$$

EP-A 340 63 1 describes a high temperature resistant steel tube with a low silicon content, which has no more than 0.1 wt. % carbon, no more than 0.15 wt. % silicon, no more than 5 wt. % manganese, 20 to 30 wt. % chromium, 15 to 30 wt. % nickel, 0.15 to 0.35 wt. % nitrogen, 0.1 to 1.0 wt. % niobium and no more than 0.005 wt. % oxygen, at least one of the metals aluminum and magnesium in quantities of 0.020 to 1.0 wt. % and 0.003 to 0.02 wt. % respectively and the remainder iron and tramp elements.

The object of the present invention is to provide alloys which are usable in many applications, which are straightforwardly workable and which have low corrosion rates.

This object is achieved with the alloys according to the invention. These alloys have a high chromium content but are nonetheless easily workable. They have only a low molybdenum content or contain no molybdenum and unexpectedly have high corrosion resistance in hot, oxidizing acids.

The present invention provides austenitic, corrosion resistant chromium, nickel, iron alloys of the following composition:

32–37 wt. % chromium
28–36 wt. % nickel
max. 2 wt. % manganese
max. 0.5 wt. % silicon
max. 0.1 wt. % aluminum
max. 0.03 wt. % carbon
max. 0.01 wt. % sulphur
max. 0.025 wt. % phosphorus
max. 2 wt. % molybdenum
max. 1 wt. % copper together with customary tramp elements and other impurities, and the remainder as iron, which are characterized in that the alloys additionally contain 0.3 to 0.7 wt. % nitrogen.

Alloys with 0.5 to 2 wt. % molybdenum and 0.3 to 1 wt. % copper are preferred.

Also preferred are austenitic alloys of the following composition:

32–35 wt. % chromium
28–36 wt. % nickel
max. 2 wt. % manganese
max. 0.5 wt. % silicon
max. 0.1 wt. % aluminum
max. 0.03 wt. % carbon
max. 0.01 wt. % sulphur
max. 0.025 wt. % phosphorus
max. 2 wt. % molybdenum
max. 1 wt. % copper together with customary tramp elements and other impurities, and the remainder as iron, which are characterized in that the alloys additionally contain 0.4 to 0.6 wt. % nitrogen.

These preferred alloys are preferably used as wrought materials for the production of semi-finished products, such as for example sheet, strip, bar, wire, forged articles, pipes, etc.

Also preferred are austenitic alloys of the following composition:

35–37 wt. % chromium
28–36 wt. % nickel
max. 2 wt. % manganese
max. 0.5 wt. % silicon
max. 0.1 wt. % aluminum
max. 0.03 wt. % carbon
max. 0.01 wt. % sulphur
max. 0.025 wt. % phosphorus
max. 2 wt. % molybdenum
max. 1 wt. % copper together with customary tramp elements and other impurities, and the remainder as iron, which are characterized in that the alloys additionally contain 0.4 to 0.7 wt. % nitrogen.

These preferred alloys are preferably used as materials for the production of castings, such as for example pumps and fittings, etc.

Also preferred are austenitic alloys of the following composition:

32.5–33.5 wt. % chromium
30.0–32.0 wt. % nickel
0.5–1.0 wt. % manganese
0.01–0.5 wt. % silicon
0.02–0.1 wt. % aluminum
max. 0.02 wt. % carbon
max. 0.01 wt. % sulphur
max. 0.02 wt. % phosphorus
0.5–2 wt. % molybdenum
0.3–1 wt. % copper
0.35–0.5 wt. % nitrogen or 34–35 wt. % chromium
30.0–32.0 wt. % nickel
0.5–1.0 wt. % manganese
0.01–0.5 wt. % silicon
0.02–0.1 wt. % aluminum
max. 0.02 wt. % carbon
max. 0.01 wt. % sulphur
max. 0.02 wt. % phosphorus
max. 0.5 wt. % molybdenum
max. 0.3 wt. % copper
0.4–0.6 wt. % nitrogen or 35.0–36.0 wt. % chromium
30.0–32.0 wt. % nickel
0.5–1.0 wt. % manganese
0.01–0.5 wt. % silicon
0.02–0.1 wt. % aluminum
max. 0.02 wt. % carbon
max. 0.01 wt. % sulphur
max. 0.02 wt. % phosphorus
max. 0.5 wt. % molybdenum
max. 0.3 wt. % copper
0.4–0.6 wt. % nitrogen or 6.0–37.0 wt. % chromium
0.0–32.0 wt. % nickel
0.5–1.0 wt. % manganese
0.01–0.5 wt. % silicon
0.02–0.1 wt. % aluminum
max. 0.02 wt. % carbon
max. 0.01 wt. % sulphur
max. 0.02 wt. % phosphorus
max. 0.5 wt. % molybdenum
max. 0.3 wt. % copper
0.4–0.7 wt. % nitrogen together with customary tramp elements and other impurities, and the remainder as iron.

In order to achieve sufficient deoxidation and desulphurization during melt treatment, the alloys may, if so required, contain up to 0.08 wt. % rare earths, up to 0.015 wt. % calcium and/or up to 0.015 wt. % magnesium as additives.

The alloys according to the invention are used as materials for articles which are resistant to:

a) sodium hydroxide solution or potassium hydroxide solution of a concentration of 1 to 90 wt. %, preferably 1 to 70 wt. %, at temperatures of up to 200° C., in particular 170° C.,
b) urea solutions of a concentration of 5 to 90 wt. %,
c) nitric acid of a concentration of 0. 1 to 70 wt. %, at temperatures up to the boiling point and up to 90 wt. % at temperatures of up to 75° C., and >90 wt. % at temperatures of up to 30° C.,
d) hydrofluoric acid of a concentration of 1 to 40 wt. %, preferably of 1 to 25 wt. %
e) phosphoric acid of a concentration of up to 85 wt. %, preferably of 26 to 52 wt. %, at temperatures of up to 120° C. or up to 300° C. at concentrations of <10 wt. %,
f) chromic acid of a concentration of up to 40 wt. %, preferably up to 30 wt. %
g) oleum of a concentration of up to 100 wt. %, preferably of up to 20 to 40 wt. % at temperatures up to the particular boiling point or
h) sulphuric acid of a concentration of 80 to 100 wt. %, preferably of 85 to 99.7 wt. %, particularly preferably of 95 to 99 wt. % at elevated temperatures of up to 250° C.

The alloys according to the invention may also be used as materials for articles which are resistant to mixtures of sulphuric acid and sodium dichromate and/or chromic acid, comprising 0.1 to 40 wt. %, preferably 0.3 to 20 wt. % nitric acid and 50 to 90 wt. % sulphuric acid at up to 130° C. or comprising 0.01 to 15 wt. % hydrofluoric acid and 80 to 98 wt. % sulphuric acid at up to 180° C. or comprising up to 25 wt. % nitric acid and up to 10 wt. % hydrofluoric acid at up to 80° C.

The alloys according to the invention have adequate resistance to and stability against organic acids, such as for example formic acid and acetic acid.

The alloys according to the invention may also be used as materials for articles which are resistant to cooling water at temperatures up to the boiling point and to sea water at up to 50° C.

Due to their good workability and corrosion resistance, the alloys according to the invention are used as a material for the production of components for use in offshore plants, in environmental engineering, space flight applications, reactor engineering and in chemical process engineering.

The alloys according to the invention may be produced using known processes in existing special stainless steel manufacturing plants and have good workability.

The overall corrosion behavior of the alloys according to the invention is outstanding. Costly alloying elements such as tungsten, niobium and tantalum may be dispensed with without degrading the favorable properties.

The alloys according to the invention also offer the advantage of an unusually universal corrosion resistance. Apparatus made from the alloys may thus be exposed to acids on the one side and to cooling and heating media containing chloride on the other, such as for example in heat exchangers. Two completely different types of corrosion resistance are thus simultaneously required, namely acid resistance on the one hand and resistance to pitting, crevice corrosion and stress corrosion cracking on the other.

The extraordinary resistance profile is simultaneously achieved with a comparatively economical alloying budget, which may otherwise be achieved only with expensive NiCrMo alloys (see Table B hereinbelow) or locally on the acid side only with specially developed ultra high-alloy materials for special applications (see Table C hereinbelow).

Additional advantages, with references to the charts and examples hereinbelow, are.

a) conservation of Ni and Mo raw material resources in comparison with the above-mentioned ultra high-alloy materials,
b) cost savings during alloy manufacture due to low levels of expensive alloy constituents and during equipment manufacture due to ready workability.

In comparison with prior art materials, the alloys according to the invention are characterized in terms of workability by an unusually low precipitation tendency on exposure to heat. This behavior is exceptionally advantageous in the production and further processing of semi-finished products, for example when shaping dished boiler heads, and in the production of welded joints. This behavior is in particular dearly evident from the time/temperature/sensitization diagrams (charts 1, 2). This material property is also significant in the behavior of weld seams, which require no final heat treatment after production, and in the production of castings.

Another engineering benefit is evident from the mechanical-technological values for the variously stressed alloys shown in Example 1, which results in a cost advantage. The strength characteristics (Example 1), which are high in comparison with standard austenites, may, for example in offshore and reactor engineering, have an advantageous influence upon component dimensions, i.e. there are potential savings to be made due to reduced material use.

Example 2 shows corrosion behavior in sulphuric acid (98 to 99.1% $H_2SO_4$) at various temperatures. The alloys according to the invention exhibit excellent corrosion resistance at up to 200° C. Under conditions of flow, which are predominantly employed in industrial practice, even lower corrosion rates are determined (Example 12).

The alloy according to the invention also exhibits excellent corrosion resistance in alkaline media, such as for example in 70% sodium hydroxide solution at 170° C. As may be seen from Example 3, corrosion resistance is virtually equivalent to that of the high-nickel materials Alloy 201, 400, 600 and 690 (17, 15, 16, 11), whereas the performance of material 12 (Alloy G-30) is sharply reduced under these conditions. The alloys according to the invention are also superior to the known alloys at low alkali concentrations and temperatures (Example 13).

Prior art copper/nickel alloys CuNi30Mn1Fe (18) have proved to be very resistant to ethanol/water mixtures with added phosphoric acid in pressure vessels at elevated temperatures, more resistant than many other tested very high-alloy steel and nickel/chromium/molybdenum alloys. As shown by Example 4, the alloys according to the invention here too exhibit corrosion behavior superior to this prior art. In comparison with the copper material, a further advantage of the alloys according to the invention is their higher strength, which makes them more suitable for the stated pressure vessel applications.

Mass loss rates determined in boiling azeotropic nitric acid are compared in Example 5. It can be seen that the alloys according to the invention suffer only very slight corrosion loss. This loss is lower than that of the known materials AISI 310 L (4) and Alloy 28 (7). The corrosion resistance of the alloys according to the invention to super-azeotropic nitric acid is superior to that of "$HNO_3$ special alloys" (Example 14).

In many material applications, it is not only resistance to uniform corrosion loss, for example by nitric acid, which is crucial, but high pitting resistance is, for example, simultaneously required on the cooling water side. In this respect, the alloys according to the invention display high resistance in the iron(HI) chloride test of Example 6 at a pitting temperature of 60° C. This resistance corresponds to that of Alloy 28 (7). However, in their combination of pitting resistance and resistance to uniform corrosion loss in boiling azeotropic nitric acid, as a typical oxidizing acid, the alloys according to the invention exhibit a distinct advantage which may be immediately exploited in this combination in units for the production of azeotropic nitric acid. The same also applies to Alloy G-30 (12). While this material is indeed somewhat superior to the alloys according to the invention in its pitting resistance, it is however very poor in terms of its resistance to uniform corrosion loss in boiling azeotropic nitric acid. The very high pitting corrosion resistance of the alloys according to the invention in neutral chloride-containing solutions, such as cooling waters, is revealed in electrochemical corrosion tests (Example 11).

Example 7 demonstrates corrosion resistance in acid mixtures of sulphuric acid and nitric acid. The alloy according to the invention is superior to known alloys at both low and high $H_2SO_4$ contents.

Example 8 shows a comparison of mass loss rates in sulphuric/hydrofluoric acid solutions. The alloys according to the invention are compared with high-chromium alloyed materials AISI 3 10 L (4), Alloy 28 (7), Alloy G-30 (12) and 1.4465 (5). It can be seen that the alloys according to the invention exhibit lower corrosion losses than the prior art materials.

Mass loss rates were also compared in phosphoric acid solutions. The results obtained are reproduced in Example 9. The alloys according to the invention are compared with prior art materials specially developed for handling phosphoric acid solutions. While the prior art material Alloy 904 L (3) can be considered adequate in solution 1, such is not the case in solution 2. While the corrosion resistance of the alloys according to the invention is not substantially different to that of the material Alloy G-30 (12), the low corrosion loss of the alloys according to the invention is, however, achieved with substantially smaller quantities of expensive alloying additives.

Example 10 shows corrosion behavior in nitric/hydrofluoric acid mixtures. The alloys according to the invention are far superior to prior art alloys.

Example 15 shows the advantageous corrosion behavior in chromic acid of the alloys according to the invention compared with known alloys.

Figure 2:
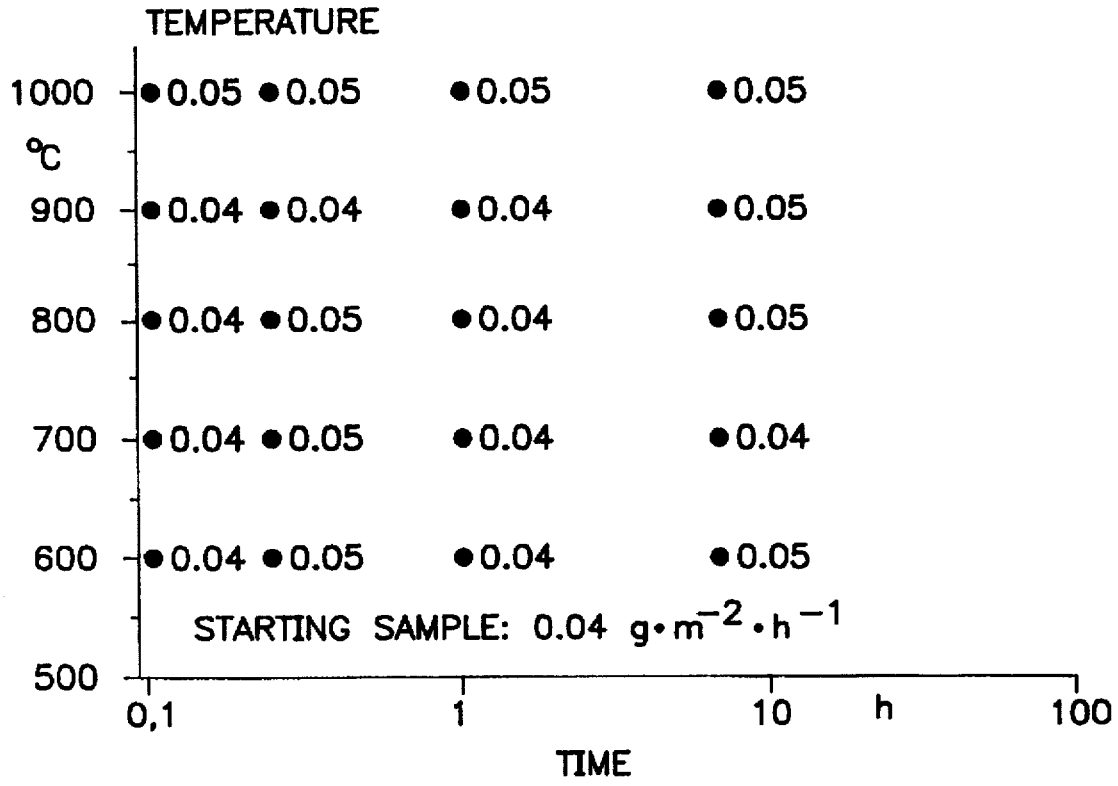

The invention will be further described hereinbelow in the examples, tests and with reference to the accompanying drawing, wherein:

FIGS. 1 and 2 are charts showing the performance of alloy 2' in accordance with the invention.

According to FIGS. 1 and 2, alloy 2' according to the invention is resistant to intercrystalline corrosion after up to 8 hours exposure to heat in the temperature range between 600° and 1000° C., both when tested according to SEP 1877 II and the Huey Test.

It is clear from the above test results that the alloys according to the invention may be used in a wide range of applications, and preferably in the following areas:

sulphuric acid production, especially for absorption stages, sulphuric acid processing, for example sulphurization, sulphonation and nitration, and concentration, production of azeotropic nitric acid and processing .and storage of nitric acid, production of hydrofluoric acid from sulphuric acid and fluorite, as well as hydrofluoric acid processing and processes using hydrofluoric acid as catalyst, use of pickling baths containing hydrofluoric, sulphuric and/or nitric acids, for example for nickel alloys and stainless steels or in electroplating and electroforming technology, production of chromic acid from sulphuric acid or oleum and sodium dichromate, use in cooling water systems and air purification installations, storage and evaporation of alkalies, for example in the production of sodium hydroxide beads, use of hot alkalies in chemical processes and as electrode materials in electrolytic processes and for pickling baths in the steel and metal industry.

The following examples are intended to illustrate the invention in greater detail.

EXAMPLES

TABLE 1

(materials according to the invention)
Values in wt. %, remainder to 100 wt. % iron.

| | Cr | Ni | Mn | Si | P | S | Mo | Cu | Al | C | N |
|---|---|---|---|---|---|---|---|---|---|---|---|
| 2' | 32.9 | 30.5 | 0.68 | 0.03 | 0.004 | 0.001 | 0.01 | 0.02 | 0.07 | 0.011 | 0.375 |
| 3' | 34.44 | 31.8 | 0.73 | 0.03 | 0.004 | 0.002 | 0.09 | <0.01 | 0.062 | 0.011 | 0.49 |
| 4' | 35.46 | 31.65 | 0.74 | 0.03 | 0.004 | 0.002 | 0.11 | 0.01 | 0.099 | 0.012 | 0.51 |
| 5' | 36.4 | 31.7 | 0.73 | 0.04 | 0.002 | 0.002 | 0.1 | 0.01 | 0.072 | 0.012 | 0.58 |
| 6' | 33.0 | 30.85 | 0.70 | 0.29 | 0.004 | 0.0017 | 0.07 | <0.01 | 0.09 | 0.0089 | 0.42 |
| 7' | 33.0 | 30.7 | 0.69 | 0.29 | 0.002 | 0.0018 | 1.5 | 0.62 | 0.058 | 0.01 | 0.406 |

TABLE 2

(comparison materials)

| No. | Name | DIN material No. | UNS name | Material designation | Main alloy elements Ni—Cr—Mo—Cu—Re—other (typical values in %) |
|---|---|---|---|---|---|
| 1 | AISI 304 L | 1.4306 | S30403 | X-2-CrNi-19-11 | 11-19 |
| 2 | AISI 316 Ti | 1.4571 | S31635 | X-2-CrNiMo17-12-2 | 10-18-2-66-0.6-Ti |
| 3 | Alloy 904 L | 1.4539 | N06904 | X-2-NiCrMoCu-25-20-5 | 25-21-4.8-1.5-46 |
| 4 | AISI 310 L | 1.4335 | — | X-2-CrNi-25-20 | 20-25 |

TABLE 2-continued (comparison materials)

| No. | Name | DIN material No. | UNS name | Material designation | Main alloy elements Ni—Cr—Mo—Cu—Re—other (typical values in %) |
|---|---|---|---|---|---|
| 5 | — | 1.4465 | — | X-2-CrNiMo-25-25-2 | 25-25-2 |
| 6 | — | 1.4466 | — | X-2-CrNiMo-25-22-2 | 22-25-2 |
| 7 | Alloy-28 | 1.4563 | N06028 | X-1-NiCrMoCu | 31-27-3.5-1.3-35 |
| 8 | Alloy-31 | 1.4562 | N06031 | X-1-NiCrMoCu-31-27-6 | 31-27-6 |
| 9 | Allcorr | — | N06110 | NiCr30Mo10Fe | 58-31-10 |
| 10 | MC-Alloy | — | — | NiCr45Mo | 53-45-1 |
| 11 | Alloy 690 | 2.4642 | N06690 | NiCr29Fe | 61-29-0.5-9 |
| 12 | Alloy G-30 | 2.4603 | N06030 | NiCr30FeMo | 30-30-6-2-17-5Co |
| 13 | Alloy C-22 | 2.4602 | N06022 | NiCr22Mo14W | 57-21-13-4-3.2W |
| 14 | Alloy 59 | 2.4605 | N06059 | NiCr22Mo16 | 51-22-16 |
| 15 | Alloy 400 | 2.4360 | N04400 | NiCu30Fe | 63-30-2 |
| 16 | Alloy 600 | 2.4816 | N06600 | NiCr15Fe | 73-16-9-0.25Ti |
| 17 | Alloy 201 | 2.4068 | N02201 | LC-Ni99.2 | >99 |
| 18 | — | 2.0882 | N71500 | CuNi30Mn1Fe | 30 |
| 19 | — | 1.4505 | — | X-3-CrNiMoTi-18-20-2 | 20-18-2 |
| 20 | AISI 310 | 1.4841 | S31000 | X-5-CrNiSi-25-20-2 | 20-25 |
| 21 | Alloy G3 | 2.4619 | N06985 | NiCr22Mo7Cu | 48-23-7-2 |
| 22 | AISI 317 | 1.4439 | S31726 | X-2-CrNiMoN-17-13-5 | 13-17-5 |

The corrosion tests were performed in accordance with the following methods known to the person skilled in the art:

a) Determination of loss/corrosion rates:

The following DIN standards were used for investigating the corrosion behavior of the materials in various acids, mixed acids and alkalies:

DIN 50905, pt. 1.: Corrosion of metals; Corrosion testing: principles. January 1987 edition.

DIN 50905, pt. 2: Corrosion of metals; Corrosion testing: Extent of corrosion in uniform general corrosion. January 1987 edition.

DIN 50905, pt. 3: Corrosion of metals; Corrosion testing: Extent of corrosion in non-uniform and local corrosion without mechanical stress. January 1987 edition.

DIN 50905, pt. 4: Corrosion of metals; Corrosion testing: Performance of chemical corrosion tests without mechanical stress in liquids in the laboratory. January 1987 edition.

ISO/DIS 8407: Metals and alloys—Procedure for removal or corrosion products from test specimens, submitted 1985–11–28 by ISO/TC 156.

b) Determination of pitting and crevice corrosion resistance:

Methods based on American test methods were used to determine the critical pitting temperature (CPT) and crevice corrosion temperature (CCT):

1. Treseder, R. S.: MTI Manual No. 3, Guideline information on newer wrought iron and nickel base corrosion resistant alloys, The Materials Technology Institute of the Chemical Process Industry, Columbus 1980, Appendix B, Method MTI-2
2. ASTM G48: Test for pitting and crevice corrosion resistance of stainless steels and related alloys by the use of ferric chloride solution.

c) The technique of cyclic potentiodynamic potential sweep (Wilde, B. E.; Corrosion 28 (1972), 283–291; Kuron, D., Gräfen, H.; Z. Werkstofftechn. 8 182–191 (1977)) has been used for a long time for comparing the pitting corrosion resistance (ranking) of various stainless steels by electrochemical methods.

In this technique the following corrosion potentials are determined:

the free corrosion potential ($U_K$) [open circuit potential ($E_{corr}$)]

the dynamic pitting corrosion potential ($U_{LD}$) [pitting potential ($E_p$)]

pitting passivation potential ($U_{LP}$) [pit repassivation potential ($E_{pp}$)]

In the performance of the electrochemical tests reference is made to the following test standards:

ASTM G3–74 (reapproved in 1981)

ASTM G5–87

According to the above methods the so-called "critical pitting temperature" (CPT) [Lau, P., Bernhardsson, 84 Electrochemical Techniques for the Study of Pitting and Crevice Corrosion Resistance of Stainless Steels, Corrosion 85, Paper No. 64, Boston (1985); Qvarfort, R.; Critical temperature measurements of stainless steels with an improved electrochemical method, Corrosion Sci., No. 8, 987–993, (1989)], at which $U_{LP}<U_K$, at which i.e. non-repassivating pitting corrosion occurs, is determined as a differentiating criterion. The potential sweep dE/dT is 180 $mV.h^{-1}$.

The steels from Table 1 were melted in 100 kg batches from per se known raw materials in a vacuum induction furnace and cast into ingots. The ingots were formed into sheet 5 or 12 mm in thickness. Final solution annealing was performed at at least 1120° C. with subsequent quenching. In each case, the structure was completely austenitic, precipitation free and homogeneous.

Example 1

Mechanical properties of the steels according to Table 1 and typical comparison materials:

Results of mechanical testing:

| Material | Thickness in [mm] | Proof stress $R_{P0.2}$ in [N/mm²] | Proof stress $R_{P1.0}$ in [N/mm²] | Tensile strength $R_m$ in [N/mm²] | Elongation at break $A_5$ in [%] | Necking Z in [%] | Brinell-hardness BH | Notched impact strength $A_V$ in [J] |
|---|---|---|---|---|---|---|---|---|
| 2' | 5 | 504 | 516 | 777 | 53 | — | 164 | — |
| 2' | 12 | 406 | 435 | 799 | — | — | 173 | >300 |
| 6' | 5 | 389 | 426 | 803 | 54 | 50 | 216 | — |
| 6' | 12 | 367 | 437 | 768 | 56 | 58 | 183 | >300 |
| 7' | 5 | 395 | 426 | 789 | 59 | 48 | 220 | — |
| 7' | 12 | 374 | 422 | 756 | 58 | 58 | 179 | >300 |
| 22 | — | 285 | — | 580–800 | 35 | — | — | >105 |
| 2 | — | 210 | — | 500–730 | 35 | — | — | >85 |

The mechanical properties of the alloys indicate good cold workability.

Example 2

Laboratory corrosion tests in stationary sulphuric acid (99.1 wt. % $H_2SO_4$) various temperatures and after 7 days' test duration (sheet thickness 4.5 mm).

| Material | Corrosion rate in [mm/a] 100° C. | 125° C. | 150° C. | 175° C. | 200° C. |
|---|---|---|---|---|---|
| 2' | 0.25 | 0.43 | 0.14 | 0.16 | 0.12 |
| 3' | 0.13 | 0.62 | 0.15 | 0.06 | 0.03 |
| 4' | 0.13 | 0.48 | 0.06 | 0.06 | 0.03 |
| 5' | 0.17 | 0.45 | 0.05 | 0.11 | 0.16 |
| 6' | 0.16 | 0.63 | 0.04 | 0.01 | 0.02 |
| 7' | 0.06 | — | — | 0.03 | 0.05 |
| 4 | 0.34 | — | 0.15 | 0.05 | 0.04 |
| 20 | 0.35 | — | 0.04 | 0.09 | 0.05 |

Corrosion tests in stationary sulphuric acid (98 wt. % $H_2SO_4$ and 98.5 wt. % $H_2SO_4$) at various temperatures and after 7 days' test duration (sheet thickness 4.5 mm):

| | Corrosion rate in [mm/a] 98% $H_2SO_4$ | | | | | 98,5% $H_2SO_4$ | | | | |
|---|---|---|---|---|---|---|---|---|---|---|
| Material | 100° C. | 125° C. | 150° C. | 175° C. | 200° C. | 100° C. | 125° C. | 150° C. | 175° C. | 200° C. |
| 2' | 0.25 | 0.54 | 0.22 | 0.21 | 0.03 | 0.09 | 0.06 | 0.11 | 0.01 | 0.03 |
| 3' | 0.22 | 0.06 | 0.32 | 0.21 | 0.09 | 0.14 | 0.13 | 0.10 | 0.21 | 0.04 |
| 4' | 0.18 | 0.07 | 0.35 | 0.20 | 0.09 | 0.14 | 0.11 | 0.18 | 0.08 | 0.12 |
| 5' | 0.20 | 0.42 | 0.07 | 0.16 | 0.08 | 0.07 | 0.11 | 0.10 | 0.53 | 0.06 |
| 6' | 0.21 | 0.04 | 0.19 | 0.17 | 0.08 | 0.08 | 0.09 | 0.07 | 0.01 | 0.03 |
| 7' | 0.04 | 0.07 | 0.08 | 0.16 | 0.34 | 0.11 | 0.11 | 0.14 | 0.32 | 0.09 |
| 20 | 0.38 | 0.43 | 0.98 | 0.38 | 0.07 | 0.11 | 0.06 | 0.77 | 0.21 | 0.81 |

Example 3

Laboratory corrosion tests in sodium hydroxide solution at various temperatures and concentrations after 14 days' test duration:

| | Corrosion rate in [mm/a] 130° C. | | | 160° C. | | 170° C. | | 250° C. |
|---|---|---|---|---|---|---|---|---|
| wt. % NaOH | 50 | 60 | 70 | 60 | 80 | 70 | 80 | 90 |
| 2' | 0.01 | 0.06 | 0.05 | 0.19 | 0.19 | 0.03 | 0.13 | 0.85 |

Comparison materials in 70% NaOH at 170° C.

| No. | 17 | 15 | 16 | 13 | 14 | 12 | 11 |
|---|---|---|---|---|---|---|---|
| Corrosion rate [mm/a] | 0.09 | 0.03 | 0.02 | 0.51 | 0.48 | 0.26 | 0.03 |

Materials 17, 15 and 16 are typical materials for this use.

Example 4

Tests in an autoclave with ethanol/water mixture with 7.5 wt. % phosphoric acid at 280° C. and 7 days' test duration:

Material no. 2' according to the invention has a corrosion rate of 0.2 mm/a.

Comparison materials under the same conditions:

| No. | 2 | 7 | 8 | 13 | 12 | 14 | 15 | 18 |
|---|---|---|---|---|---|---|---|---|
| Corrosion rate [mm/a] | 1.77 | 0.44 | 0.44 | 0.53 | 0.63 | 0.41 | 0.41 | 0.26 |

Example 5

Corrosion behavior in boiling azeotropic nitric acid using Huey Test distillation method:

| No. | Mass loss rates [g/m² · h] 48 h (5 cycles) | 48 h (10 cycles) | 48 h (15 cycles) |
|---|---|---|---|
| 2' | 0.04 | 0.04 | 0.04 |
| 3' | 0.04 | 0.04 | 0.04 |
| 4' | 0.04 | 0.04 | 0.04 |
| 5' | 0.03 | 0.04 | 0.04 |
| 6' | 0.04 | 0.04 | 0.04 |
| 7' | 0.04 | 0.04 | 0.04 |
| 1 | 0.12 | 0.12 | 0.12 |
| 4 | 0.06 | 0.07 | 0.07 |
| 5 | 0.09 | 0.09 | 0.09 |
| 7 | 0.07 | 0.07 | 0.07 |
| 8 | 0.09 | 0.10 | 0.10 |
| 12 | 0.14 | 0.13 | 0.13 |

Example 6

Determination of pitting and crevice corrosion temperatures in $FeCl_3$ test with 10 wt. % $FeCl_3.6H_2O$:

| No. | CPT [°C.] | CCT [°C.] |
|---|---|---|
| 2' | 60 | 40 |
| 3' | 85 | — |
| 4' | 85 | — |
| 5' | 85 | — |
| 6' | 70 | 35 |
| 7' | 85 | 40 |
| 2 | 10 | −2.5 |
| 3 | 45 | 25 |
| 4 | 25 | ≦20 |
| 5 | 40 | 25 |
| 7 | 60 | 35 |
| 8 | 85 | 60 |
| 9 | >90 | >90 |
| 10 | 50 | ≦20 |
| 11 | 45 | ≦20 |
| 12 | 75 | 50 |

Example 7

Corrosion behavior in mixtures of various concentrations of sulphuric acid containing different quantities of nitric acid at 100° C.; after 7 days' test duration:

| Material | Corrosion rate in [mm/a] Wt. % $H_2SO_4$ 66.5 | | | 76 | | | 80 | 50 |
|---|---|---|---|---|---|---|---|---|
| | Wt. % $HNO_3$ | | | | | | | |
| No. | 0 | 3 | 5 | 0 | 3 | 5 | 5 | 5 |
| 2' | >50 | 0.08 | 0.08 | 1.18 | 0.15 | 0.18 | 0.10 | 0.03 |
| 2 | >50 | 0.54 | 0.53 | >50 | 0.60 | 0.80 | 0.85 | 0.28 |
| 7 | 35.43 | 0.08 | 0.09 | 21.55 | 0.13 | 0.13 | 0.24 | 0.05 |
| 8 | >50 | 0.07 | 0.09 | 13.85 | 0.11 | 0.12 | 0.21 | 0.05 |
| 12 | 49.4 | 0.10 | 0.08 | 9.06 | 0.10 | 0.11 | 0.17 | 0.05 |

Example 8

Corrosion tests in sulphuric/hydrofluoric add solutions:

Solution 1: 92.4% $H_2SO_4$/7.6% $H_2O$/trace HF; T=150° C.

Solution 2: 91.2% $H_2SO_4$/7.4% $H_2O$/1.4% HF; T=140° C.

Solution 3: 90–94% $H_2SO_4$/4–7% $H_2O$/2–3% HF; T=140° C.

| Test period Material | Corrosion rate in [mm/a] Solution 1 [14 d] | Solution 2 [14 d] | Solution 3 [89 d] |
|---|---|---|---|
| 2' | 0.15 | 0.02 | 0.01 |
| 19 | 0.84 | 0.17 | 0.31 |
| 4 | 0.26 | 0.10 | 0.07 |
| 5 | 0.33 | 0.05 | 0.05 |
| 3 | 0.39 | 0.09 | 0.14 |
| 7 | 0.51 | 0.05 | 0.04 |
| 8 | 0.71 | 0.06 | 0.08 |
| 13 | 0.60 | 0.14 | 0.09 |
| 12 | 1.01 | 0.06 | 0.04 |

Example 9

Corrosion rates [mm/a] in aqueous phosphoric acid solutions

Solution 1: 75 wt. % $H_3PO_4$; 80° C., 14 days

Solution 2: 75 wt. % $H_3PO_4$, 0.63 wt. % $F^-$, 0.3 wt. % $Fe^{3+}$, 14 mmol/l $Cl^-$; 80° C., 14 days

| Material-No. | Solution 1 | Solution 2 |
|---|---|---|
| 2' | <0.01 | 0.18 |
| 3 | 0.07 | 1.70 |
| 7 | 0.01 | 0.42 |
| 12 | 0.01 | 0.19 |

Example 10

Corrosion behavior in nitric/hydrofluoric acid mixtures; mass loss rates in [g/m²h]; T=90° C.

| Material No. | Soln. 1 | Soln. 2 | Soln. 3 | Soln. 4 | Soln. 5 | Soln. 6 | Soln. 7 |
|---|---|---|---|---|---|---|---|
| 2' | <0.01 | 0.27 | 0.96 | 0.31 | 0.63 | 1.63 | 3.05 |
| 6' | <0.01 | 0.28 | 1.45 | 0.29 | 0.68 | 1.64 | 3.00 |
| 7' | <0.01 | 0.24 | 1.19 | 0.27 | 0.67 | 1.66 | 3.08 |
| 7 | <0.01 | 5.74 | 20.74 | 0.96 | 1.78 | 3.38 | 5.46 |
| 21 | <0.01 | 1.11 | 5.23 | 1.51 | 3.61 | 8.10 | 11.63 |
| 11 | <0.01 | 0.61 | 6.34 | 1.46 | 1.97 | 4.69 | 7.42 |
| 12 | <0.01 | 0.28 | 1.21 | 0.49 | 1.45 | 2.39 | 4.49 |

Solution 1: 2 mol/l $HNO_3$

Solution 2: 2 mol/l $HNO_3$+0.5 mol/l HF

Solution 3: 2 mol/l $HNO_3$+2 mol/l HF

Solution 4: 0.25 mol/l HF+6 mol/l $HNO_3$

Solution 5: 0.25 mol/l HF+9 mol/l $HNO_3$

Solution 6: 0.25 mol/l HF+12 mol/l $HNO_3$

Solution 7: 0.25 mol/l HF+15 mol/l $HNO_3$

Example 11

Determination of pitting corrosion behavior by potentiodynamic polarization curves as a function of the repassivation potential $E_{PP}$; conditions required: $E_{PP}<E_{Corr}$ (free corrosion potential)

Pitting corrosion temperatures in 1.0 n NaCl solution,

| sweep rate $\left[\frac{dU}{dt}\right]$ : 180 mVh$^{-1}$ | |
|---|---|
| No. | CPT [°C.] |
| 2' | 80 |
| 6' | 90 |
| 7' | >95 |
| 2 | 45 |
| 3 | 75 |
| 4 | 60 |
| 5 | 60 |
| 8 | 95 |

Example 12

Corrosion tests under service conditions in sulphuric acid (9.6–98.5% by weight) at T=135°–140° C.

| | corrosion rate in [mm · a$^{-1}$] | | |
|---|---|---|---|
| Material | after [14 d] | after [34 d] | after [50 d] |
| 2' | 0.01 | <0.01 | <0.01 |
| | <0.01 | <0.01 | <0.01 |
| 6' | 0.01 | 0.01 | <0.01 |
| | 0.01 | <0.01 | <0.01 |
| 7' | 0.01 | <0.01 | <0.01 |
| | <0.01 | <0.01 | <0.01 |
| 20 | 0.01 | <0.01 | <0.01 |
| | 0.01 | <0.01 | <0.01 |

| Ma- | A | | | B | | | |
|---|---|---|---|---|---|---|---|
| terial | 75° C. | 100° C. | 104° C. | 75° C. | 100° C. | 125° C. | 143° C. |
| 2' | <0.01 | <0.01 | <0.01 | <0.01 | <0.01 | <0.01 | <0.01 |
| 6' | <0.01 | <0.01 | <0.01 | <0.01 | <0.01 | <0,01 | <0.01 |
| 7' | <0.01 | <0.01 | <0.01 | <0.01 | <0.01 | <0.01 | <0.01 |
| 1 | <0.01 | 0.05 | 0.13 | 0.09 | 0.47 | 2.36 | 9.74 |
| 2 | <0.01 | 0.12 | 0.63 | 0.08 | 0.35 | 1.60 | 7.99 |
| 5 | <0.01 | 0.03 | 0.02 | <0.01 | <0.0 | 0.26 | 1.35 |
| 7 | <0.01 | <0.01 | 0.06 | <0.01 | <0.01 | 0.12 | 0.62 |
| 8 | <0.01 | 0.02 | 0.02 | <0.01 | <0.01 | 0.13 | 0.67 |

143° C. ▲ boiling point

| Mate- | Soln. 1 | | | Soln. 2 | | | Soln. 3 | | | Soln. 4 | | |
|---|---|---|---|---|---|---|---|---|---|---|---|---|
| rial | 25° C. | 50° C. | 75° C. | 25° C. | 50° C. | 75° C. | 25° C. | 50° C. | 75° C. | 25° C. | 50° C. | BP* |
| 2' | <0.01 | <0.01 | 0.03 | <0.01 | <0.01 | <0.01 | <0.01 | <0.01 | 0.07 | 0.04 | 0.20 | 0.60 |
| 1 | <0.01 | 0.01 | 0.11 | <0.01 | 0.01 | 0.08 | 0.03 | 0.03 | 0.53 | 0.18 | 0.56 | 1.33 |
| 4 | <0.01 | <0.01 | 0.08 | <0.01 | 0.02 | 0.06 | 0.03 | 0.02 | 0.14 | 0.17 | 1.02 | 4.11 |

*BP = boiling point*

| Material | Solution 1 | | | | Solution 2 | | | |
|---|---|---|---|---|---|---|---|---|
| | 20° C. | 40° C. | 60° C. | 80° C. | 20° C. | 40° C. | 60° C. | 80° C. |
| 2' | 0.06 | 0.20 | 0.71[6)] | 2.62[2)] | 0.19[6)] | 1.08[6)] | 7.17[4)] | 21[2)] |
| 6' | — | — | — | — | 0.23 | — | — | — |
| 7' | — | — | — | — | 0.28 | — | — | — |
| 7 | 0.07 | 0.21 | 1.73[6)] | 13.7[2)] | 0.41[6)] | 0.77[4)] | 8.6[2)] | 54[2)] |
| 8 | 0.08 | 0.23 | 2.29[2)] | 11.79[2)] | 0.40[6)] | 1.58[4)] | 6.22[2)] | 41[3)] |
| 12 | 0.07 | 0.17 | 1.11[6)] | 5.60[2)] | 0.21[6)] | 1.02[4)] | 3.63[2)] | 19.5[2)] |

[2)]Test duration = 2 days
[3)]Test duration = 3 days
[4)]Test duration = 4 days
[6)]Test duration = 6 days

TABLE A

Prior art alloys and steels for applications in nitric acid (A), urea (B), highly concentrated sulphuric acid (C)

| | Name | Material No. | Major alloy elements (in %) Ni | Cr | Mo | Fe | Other |
|---|---|---|---|---|---|---|---|
| A | CRONIFER ® | | | | | | |
| | 1809 LC | 1.4306 | 10 | 18 | | 68 | |
| | 1809 LCLSi | 1.4306 | 13 | 20 | | 66 | |
| | 2521 LC | 1.4335 | 21 | 25 | | 53 | |
| | 1815 LCSi | 1.4361 | 15 | 18 | | 61 | 4 Si |
| | NICROFER ® | | | | | | |
| | 6030 | 2.4642 | 61 | 29 | | 9 | 0.25 Ti |
| | 2509 Si7 | 1.4390 | 25 | 9 | | 57 | 7 Si |
| B | CRONIFER ® | | | | | | |
| | 1812 LC | 1.4435 | 13 | 17 | 2.6 | 65 | |

TABLE A-continued

Prior art alloys and steels for applications in nitric acid (A), urea (B), highly concentrated sulphuric acid (C)

| | Name | Material No. | Major alloy elements (in %) Ni | Cr | Mo | Fe | Other |
|---|---|---|---|---|---|---|---|
| | 1812 LCN | 1.4429 | 13 | 17 | 2.6 | 65 | 0.17 N |
| | 2522 LCN | 1.4466 | 22 | 25 | 2.1 | 48 | 0.13 N |
| | 2525 Ti | 1.4577 | 25 | 25 | 2.1 | 46 | 0.25 Ti |
| C | CRONIFER ® | | | | | | |
| | 2803 Mo (Superferrit) | 1.4575 | 3.7 | 29 | 2.3 | 64 | 0.35 Nb |
| | NICROFER ® | | | | | | |
| | 2509 Si7 | 1.4390 | 25 | 9 | | 57 | 7 Si |

TABLE B

Overview of general corrosion resistance

| Material | Corrosion resistance: Pitting CPT[1)] | Crevice corrosion CCT[2)] | Alkalis | Mixed acids $H_2SO_4/HNO_3$ | Mixed acids $H_2SO_4/HF$ | $HNO_3$ 67% | $HNO_3$ >95% | $H_2SO_4$ >85% | $H_3PO_4$ |
|---|---|---|---|---|---|---|---|---|---|
| 1 | – | — | — | * | — | + | — | — | — |
| 2 | – | — | — | — | — | — | — | — | — |
| 3 | + | + | * | * | + | — | — | ++ | * |
| 4 | + | + | * | * | ++ | + | — | ++ | * |
| 5 | + | + | * | * | ++ | ++ | – | ++ | * |
| 6 | + | + | * | * | * | ++ | – | * | * |
| 7 | ++ | ++ | * | ++ | ++ | ++ | – | + | + |
| 8 | +++ | +++ | * | ++ | ++ | ++ | — | – | + |
| 9 | +++ | +++ | * | * | * | * | — | * | * |
| 10 | ++ | * | * | * | * | * | – | * | * |
| 11 | ++ | – | +++ | * | * | * | – | * | * |
| 12 | +++ | ++ | – | * | ++ | ++ | — | — | – |
| 13 | +++ | +++ | — | * | ++ | – | — | – | – |
| 14 | +++ | +++ | — | * | * | — | — | * | – |
| 15 | – | – | +++ | * | * | — | — | — | * |
| 16 | – | – | +++ | * | * | — | — | — | * |

TABLE B-continued

Overview of general corrosion resistance

| Material | Pitting CPT[1)] | Crevice corrosion CCT[2)] | Alkalis | Mixed acids $H_2SO_4/HNO_3$ | Mixed acids $H_2SO_4/HF$ | $HNO_3$ 67% | $HNO_3$ >95% | $H_2SO_4$ >85% | $H_3PO_4$ |
|---|---|---|---|---|---|---|---|---|---|
| 17 | – | – | ++ | * | * | — | — | — | – |
| 2' | ++ | ++ | +++ | ++ | +++ | +++ | ++ | + | *** |

Key:
+++ = outstanding corrosion behavior
++ = good corrosion behavior
+ = moderate corrosion behavior
– = poor corrosion behavior
— = very poor corrosion behavior
* = not determined
[1)]CPT △ determination of pitting temperature using $FeCl_3$ test (10% $FeCl_3.6H_2O$)
[2)]CCT △ determination of crevice corrosion temperature using $FeCl_3$ test (10% $FeCl_3.6H_2O$)

TABLE C

Materials for special applications

| Material No. | Application | Reference |
|---|---|---|
| 1.4361 | azeotropic, highly concentrated $HNO_3$ | Horn, E.-M.; Kohl, H.: Werkstoffe und Korrosion 37, 57-69 (1986) |
| 1.4575 | highly concentrated sulphuric acid, ≧94% | EP-A 361 554 |
| 1.4335 | concentrated sulphuric acid | DE-A 3 508 532 |
| Sandvik SX | concentrated sulphuric acid | GB 1,534,926 |
| 1.4361 | $H_2SO_4$ production | US 4,543,244 |
| 1.4390 | concentrated $HNO_3$ concentrated sulphuric acid | EP-A 516 955 |

It is understood that the specification and examples are illustrative but not limitative of the present invention and that other embodiments within the spirit and scope of the invention will suggest themselves to those skilled in the art.

We claim:

1. An austenitic, corrosion-resistant chromium, nickel, iron wrought alloy of the following approximate composition:

| | |
|---|---|
| 32–37 | % by weight of chromium, |
| 28–34 | % by weight of nickel, |
| a maximum of 2 | % by weight of manganese, |
| a maximum of 0.4 | % by weight of silicon, |
| a maximum of 0.1 | % by weight of aluminium, |
| a maximum of 0.02 | % by weight of carbon, |
| a maximum of 0.025 | % by weight of phosphorus, |
| a maximum of 0.01 | % by weight of sulphur, |
| 0.5–2 | % by weight of molybdenum, |
| 0.3–1 | % by weight of copper, and |
| 0.3–0.7 | % by weight of nitrogen, |

the nickel content being lower than the chromium content, and the remainder approximately iron.

2. An austenitic alloy according to claim 1 of the following approximate composition:

| | |
|---|---|
| 32–35 | % by weight of chromium, |
| 28–34 | % by weight of nickel, |

-continued

| | |
|---|---|
| a maximum of 2 | % by weight of manganese, |
| a maximum of 0.4 | % by weight of silicon, |
| a maximum of 0.1 | % by weight of aluminium, |
| a maximum of 0.02 | % by weight of carbon, |
| a maximum of 0.01 | % by weight of sulphur, |
| a maximum of 0.025 | % by weight of phosphorus, |
| 0.5–2 | % by weight of molydenum, |
| 0.3–1 | % by weight of copper, and |
| 0.4–0.6 | % by weight of nitrogen, |

the nickel content being lower than the chromium content, and the remainder approximately iron.

3. An austenitic alloy according to claim 1 of the following approximate composition:

| | |
|---|---|
| 35–37 | % by weight of chromium, |
| 28–34 | % by weight of nickel, |
| a maximum of 2 | % by weight of manganese, |
| a maximum of 0.4 | % by weight of silicon, |
| a maximum of 0.1 | % by weight of aluminium, |
| a maximum of 0.02 | % by weight of carbon, |
| a maximum of 0.01 | % by weight of sulphur, |
| a maximum of 0.025 | % by weight of phosphorus, |
| 0.5–2 | % by weight of molybdenum, |
| 0.3–1 | % by weight of copper, and |
| 0.4–0.7 | % by weight of nitrogen, |

the nickel content being lower than the chromium content, and the remainder approximately iron.

4. An austenitic alloy according to claim 1 of the following approximate composition:

| | |
|---|---|
| 32.5–33.5 | % by weight of chromium, |
| 30.0–32.0 | % by weight of nickel, |
| 0.5–1.0 | % by weight of manganese, |
| 0.01–0.4 | % by weight of silicon, |
| 0.02–0.1 | % by weight of aluminium, |
| a maximum of 0.02 | % by weight of carbon, |
| a maximum of 0.01 | % by weight of sulphur, |
| a maximum of 0.02 | % by weight of phosphorus, |
| 0.5–2 | % by weight of molydenum, |
| 0.3–1 | % by weight of copper, and |
| 0.35–0.5 | % by weight of nitrogen, |

the nickel content being lower than the chromium content, and the remainder approximately iron.

5. An austenitic alloy according to claim 1 of the following approximate composition:

| | |
|---|---|
| 34.0–35.0 | % by weight of chromium, |
| 30–32 | % by weight of nickel, |
| 0.5–1.0 | % by weight of manganese, |
| 0.01–0.4 | % by weight of silicon, |
| 0.02–0.1 | % by weight of aluminium, |
| a maximum of 0.02 | % by weight of carbon, |
| a maximum of 0.01 | % by weight of sulphur, |
| a maximum of 0.02 | % by weight of phosphorus, |
| 0.5–1 | % by weight of molydenum, |
| 0.3–0.7 | % by weight of copper, and |
| 0.4–0.6 | % by weight of nitrogen, |

the nickel content being lower than the chromium content, and the remainder approximately iron.

6. An austenitic alloy according to claim 1 of the following approximate composition:

| | |
|---|---|
| 35.0–36.0 | % by weight of chromium, |
| 30–32 | % by weight of nickel, |
| 0.5–1.0 | % by weight of manganese, |
| 0.01–0.4 | % by weight of silicon, |
| 0.02–0.1 | % by weight of aluminium, |
| a maximum of 0.02 | % by weight of carbon, |
| a maximum of 0.01 | % by weight of sulphur, |
| a maximum of 0.02 | % by weight of phosphorus, |
| 0.5–1 | % by weight of molydenum, |
| 0.3–0.7 | % by weight of copper, and |
| 0.4–0.6 | % by weight of nitrogen, |

the nickel content being lower than the chromium content, and the remainder approximately iron.

7. An austenitic alloy according to claim 1 of the following approximate composition:

| | |
|---|---|
| 36.0–37.0 | % by weight of chromium, |
| 30–32 | % by weight of nickel, |
| 0.5–1.0 | % by weight of manganese, |
| 0.01–0.4 | % by weight of silicon, |
| 0.02–0.1 | % by weight of aluminium, |
| a maximum of 0.02 | % by weight of carbon, |
| a maximum of 0.01 | % by weight of sulphur, |
| a maximum of 0.02 | % by weight of phosphorus, |
| 0.5–1 | % by weight of molydenum, |
| 0.3–0.7 | % by weight of copper, and |
| 0.4–0.7 | % by weight of nitrogen, |

the nickel content being lower than the chromium content, and the remainder approximately iron.

8. Alloys according to claim 1 as wrought materials for the production of sheet, strip, bar, wire, forged articles, pipes.

9. Alloys according to claim 1 as materials for the production of castings.

10. A structural component formed of an alloy according to claim 1.

11. In the contacting of a structural component with a sodium hydroxide or potassium hydroxide solution of a concentration from 1 to 90 wt. % up to 200° C., the improvement wherein said component is formed of an alloy according to claim 1.

12. In the contacting of a structural component with a urea solution of a concentration of 5 wt. % to 90 wt. % the improvement wherein said component is formed of an alloy according to claim 1.

13. In the contacting of a structural component with nitric acid of a concentration of 0.1 wt. % to 70 wt. % at a temperature of up to boiling point and up to 90 wt. % at a temperature of up to 75° C. and >90 wt. % at a temperature of up to 30° C., the improvement wherein said component is formed of an alloy according to claim 1.

14. In the contacting of a structural component with hydrofluoric acid of a concentration from 1 wt. % to 40 wt. %, the improvement wherein said component is formed of an alloy according to claim 1.

15. In the contacting of a structural component with phosphoric acid of a concentration of up to 85 wt. % at temperatures of up to 120° C. and of up to 10 wt. % at temperatures of up to 300° C., the improvement wherein said component is formed of an alloy according to claim 1.

16. In the contacting of a structural component with chromic acid of a concentration of up to 40 wt. %, the improvement wherein said component is formed of an alloy according to claim 1.

17. In the contacting of a structural component with oleum of a concentration of up to 100 wt. % at a temperature up to the boiling point, the improvement wherein said component is formed of an alloy according to claim 1.

18. In the contacting of a structural component with sulphuric acid of a concentration of 80 wt. % to 100 wt. % at a temperature of up to 250° C., the improvement wherein said component is formed of an alloy according to claim 1.

19. In the contacting of a structural component with a mixture of sulphuric acid and at least one of sodium dichromate and chromic acid, the improvement wherein said component is formed of an alloy according to claim 1.

20. In the contacting of a structural component with an aqueous mixture of 0.1 to 40 wt. % nitric acid and 50 to 90 wt. % sulphuric acid at a temperature of up to 130° C., the improvement wherein said component is formed of an alloy according to claim 1.

21. In the contacting of a structural component with an aqueous mixture of 0.01 to 15 wt. % hydrofluoric acid and 80 to 98 wt. % sulphuric acid at a temperature of up to 180° C.,the improvement wherein said component is formed of an alloy according to claim 1.

22. In the contacting of a structural component with an aqueous mixture of up to 25 wt. % nitric acid and up to 10 wt. % hydrofluoric acid at a temperature of up to 80° C., the improvement wherein said component is formed of an alloy according to claim 1.

23. In the contacting of a structural component with cooling water at up to boiling temperature or to sea water at up to 50° C., the improvement wherein said component is formed of an alloy according to claim 1.

* * * * *